US009810111B2

(12) United States Patent
Sotani et al.

(10) Patent No.: US 9,810,111 B2
(45) Date of Patent: Nov. 7, 2017

(54) OIL SUPPLY STRUCTURE OF WATER-COOLED INTERNAL COMBUSTION ENGINE

(71) Applicant: HONDA MOTOR CO., LTD., Tokyo (JP)

(72) Inventors: Hiroshi Sotani, Wako (JP); Hiroshi Yokota, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 152 days.

(21) Appl. No.: 14/844,718

(22) Filed: Sep. 3, 2015

(65) Prior Publication Data

US 2016/0084147 A1 Mar. 24, 2016

(30) Foreign Application Priority Data

Sep. 18, 2014 (JP) ..... 2014-189532

(51) Int. Cl.

| | |
|---|---|
| ***F01M 1/02*** | (2006.01) |
| ***F02M 25/00*** | (2006.01) |
| ***F01P 5/10*** | (2006.01) |
| *F01M 1/10* | (2006.01) |
| *F01M 5/00* | (2006.01) |
| *F01P 5/12* | (2006.01) |
| *F01M 11/00* | (2006.01) |

(52) U.S. Cl.

CPC ..... *F01M 1/02* (2013.01); *F01P 5/10* (2013.01); *F01M 1/10* (2013.01); *F01M 5/002* (2013.01); *F01M 11/00* (2013.01); *F01M 2001/0276* (2013.01); *F01P 5/12* (2013.01)

(58) Field of Classification Search

CPC F01M 1/02; F01M 1/10; F01M 5/002; F01M 2001/0276; F01M 11/00; F01P 5/12; F01P 5/10

USPC ..... 123/196 A, 196 R, 193.5, 188.14, 198 E

See application file for complete search history.

(56) References Cited

U.S. PATENT DOCUMENTS

| | | | | |
|---|---|---|---|---|
| 6,823,829 | B1 * | 11/2004 | Kawamoto | F01M 1/02 123/196 R |
| 2007/0044757 | A1 * | 3/2007 | Suzuki | F02D 9/1055 123/339.23 |
| 2008/0060606 | A1 * | 3/2008 | Inui | F01M 11/02 123/196 A |
| 2008/0184956 | A1 * | 8/2008 | Inui | F01L 1/022 123/193.5 |

FOREIGN PATENT DOCUMENTS

| | | |
|---|---|---|
| JP | 2008-64079 A | 3/2008 |

* cited by examiner

*Primary Examiner* — Syed O Hasan
(74) *Attorney, Agent, or Firm* — Birch, Stewart, Kolasch & Birch, LLP

(57) ABSTRACT

An oil supply structure of a water-cooled internal combustion engine includes an oil cooler for improving oil circulation efficiency by making an oil passage of a lubrication system short. In addition, weight of the oil cooler is reduced by reducing the number of parts. The oil supply structure of a water-cooled internal combustion engine includes an oil pump drive shaft of an oil pump that is coaxially coupled with one end of a balancer shaft placed parallel with a crankshaft and a water pump drive shaft of a water pump that is coaxially coupled with the other end of the balancer shaft. In the oil supply structure, an oil cooler is provided in the vicinity of the oil pump together with an oil filter.

8 Claims, 14 Drawing Sheets

OIL SUPPLY STRUCTURE OF WATER-COOLED INTERNAL COMBUSTION ENGINE

CROSS-REFERENCE TO RELATED APPLICATIONS

The present application claims priority under 35 USC 119 to Japanese Patent Application No. 2014-189532 filed Sep. 18, 2014 the entire contents of which are hereby incorporated by reference.

BACKGROUND OF THE INVENTION

1. Field of the Invention

The present invention relates to an oil supply structure of a water-cooled internal combustion engine to be mounted on a vehicle.

2. Description of Background Art

A water-cooled internal combustion engine is known that includes a water pump operatively connected to a cooling system and an oil pump operatively connected to a lubrication system being provided on both sides of a balancer shaft that is placed parallel with a crankshaft. An oil pump drive shaft and a water pump drive shaft are coaxially coupled with both ends of the balancer shaft so that the water pump and the oil pump are driven with a simplest structure with a small number of parts. See, for example, JP-A No. 2008-64079.

The water-cooled internal combustion engine disclosed in JP-A No. 2008-64079 is mounted in a vehicle in a so-called vertical placement posture in which the crankshaft is oriented in the vehicle body front-rear direction, the water pump drive shaft of the water pump is coaxially coupled with the front end of the balancer shaft placed parallel with the crankshaft, and the oil pump drive shaft of the oil pump is coaxially coupled with the rear end of the balancer shaft.

The water-cooled internal combustion engine comprises a water-cooled oil cooler with the oil cooler being placed further forward than a radiator of the cooling system placed at a front part of a vehicle body.

Because water piping of the cooling system that couples the water pump is provided at a front part of the internal combustion engine, the radiator placed at a front part of the vehicle body, or the like is structured at a front area of the vehicle body. The water piping may extend a little and coupled with the oil cooler so that oil flowing thorough the oil cooler can be easily cooled.

SUMMARY AND OBJECTS OF THE INVENTION

However, because the oil circulating inside the internal combustion engine is cooled by the oil cooler, an external pipe is laid from the internal combustion engine to the oil cooler placed at a front part of the vehicle body.

Because the external pipe extends out from the vicinity of the oil pump provided at a rear part of the internal combustion engine, the distance up to the oil cooler at a front part of the vehicle body with which the external pipe has to couple is long. Two external pipes are provided, one for the front direction and the other for the backward direction. As a result, the oil passage becomes long, the oil circulation efficiency deteriorates, the number of parts increases. Thus, the weight increases.

According to an embodiment of the present invention, an oil supply structure of a water-cooled internal combustion engine is provided that includes an oil cooler, which makes it possible to efficiently improve oil circulation by making the oil passage of the lubrication system short, and to reduce the weight by reducing the number of parts.

According to an embodiment of the present invention, an oil supply structure of a water-cooled internal combustion engine in which an oil pump drive shaft of an oil pump is coaxially coupled with one end of a balancer shaft placed parallel with a crankshaft and a water pump drive shaft of a water pump is coaxially coupled with the other end of the balancer shaft. The oil supply structure of the water-cooled internal combustion engine includes an oil cooler that is provided in the vicinity of the oil pump together with an oil filter.

According to an embodiment of the present invention, an engine case cover, that covers the oil pump from a side opposite to the water pump, is provided with the oil filter and the oil cooler.

According to an embodiment of the present invention, an oil tank is formed inside the engine case cover with a cooler inlet and a cooler outlet of the oil cooler being formed on an attachment surface to which the oil cooler of the engine case cover is attached. The cooler outlet is opened at an upper part of the oil tank.

According to an embodiment of the present invention, the oil filter is provided at the same height as or a lower position than the oil pump.

According to an embodiment of the present invention, the oil pump may be a scavenging pump that pumps up oil to the oil tank, a clutch oil pump that pressure-feeds oil from the oil tank to a hydraulic clutch, and an engine oil pump that supplies oil to each lubrication portion of the internal combustion engine that are placed side by side on the oil pump drive shaft. The clutch oil pump is placed by being sandwiched between the scavenging pump and the engine oil pump.

According to an embodiment of the present invention, the oil filter is composed of a clutch oil filter interposed in a discharge oil passage of the clutch oil pump and an engine oil filter interposed in a discharge oil passage of the engine oil pump. The clutch oil filter and the engine oil filter are provided in the vicinity of the oil pump.

According to an embodiment of the present invention, the internal combustion engine is mounted on a vehicle with the crankshaft being oriented in the vehicle front-rear direction. The water pump is placed on the front side of the balancer shaft with the oil pump being placed on the rear side of the balancer shaft.

According to an embodiment of the present invention, water piping is provided that makes a water jacket of a cylinder block and a water jacket of the oil cooler of the internal combustion engine communicate with each other.

According to an embodiment of the present invention, in an oil supply structure of a water-cooled internal combustion engine in which an oil pump drive shaft of an oil pump is coaxially coupled with one end of a balancer shaft placed parallel with a crankshaft, and a water pump drive shaft of a water pump is coaxially coupled with the other end of the balancer shaft, an oil cooler is provided in the vicinity of the oil pump together with an oil filter. Thus, an oil passage that communicates with the oil cooler can be set short. Therefore, it is possible to efficiently improve the oil circulation and to reduce the weight by reducing the number of parts.

According to an embodiment of the present invention, an engine case cover that covers the oil pump from a side opposite to the water pump is provided with the oil filter and the oil cooler. Thus, the oil cooler can be provided intensively and efficiently together with the oil filter in the vicinity of the oil pump, and it is possible to downsize and reduce the weight of the internal combustion engine.

According to an embodiment of the present invention, an oil tank is formed inside the engine case cover, resulting in the oil pump, the oil filter, and the oil cooler being provided around the oil tank. Thus, the lubrication system can be intensively structured and made compact.

Because a cooler inlet and a cooler outlet of the oil cooler are formed on an attachment surface to which the oil cooler of the engine case cover is attached, oil piping to the oil cooler is not necessary. Thus, the number of parts can be reduced, and downsizing is possible.

Also, because the cooler outlet opens at an upper part of the oil tank, oil cooled by the oil cooler is caused to fall from a high position of the oil tank, and mixes vigorously with oil collected in the oil tank; thereby, the oil can be stirred efficiently, and the temperature can be adjusted efficiently.

According to an embodiment of the present invention, the oil filter is provided at the same height with or a lower position than the oil pump, the discharge hydraulic pressure of the oil pump that pressure-feeds the oil to the oil filter can be kept low. Thus, sufficient oil can be supplied to each requiring portion of the internal combustion engine without upsizing of the oil pump.

According to an embodiment of the present invention, with regard to the oil pump, a scavenging pump that pumps up oil to the oil tank, a clutch oil pump that pressure-feeds oil from the oil tank to a hydraulic clutch, and an engine oil pump that supplies oil to each lubrication portion of the internal combustion engine are placed side by side on the oil pump drive shaft. Thus, the three types of oil pumps can be compactly formed into a unit.

Because the clutch oil pump with particularly high oil discharge pressure is placed by being sandwiched between the scavenging pump and the engine oil pump, the pressure resistance of a clutch oil pump chamber can be easily ensured without upsizing of the parts.

According to an embodiment of the present invention, the oil filter is composed of a clutch oil filter interposed in a discharge oil passage of the clutch oil pump and an engine oil filter interposed in a discharge oil passage of the engine oil pump. The clutch oil filter and the engine oil filter are provided together in the vicinity of the oil pump. Thus, the lubrication system can be intensively structured and downsized.

According to an embodiment of the present invention, the internal combustion engine is mounted on a vehicle with the crankshaft being oriented in the vehicle front-rear direction, the water pump is placed on the front side of the balancer shaft parallel with the crank shaft, and the oil pump is placed on the rear side of the balancer shaft. The water pump provided at a front part of the internal combustion engine is relatively close to the radiator placed at a front part of the vehicle body with the water piping of the cooling system being set short with good space efficiency. Thus, it is possible to reduce the weight by reducing the number of parts.

According to an embodiment of the present invention, water piping that makes a water jacket of a cylinder block and a water jacket of the oil cooler of the internal combustion engine communicate with each other is provided. Thus, necessary water circulation becomes possible without laying a pipe dedicated to pressure-feeding from the water pump to the oil cooler. In addition, because the oil cooler provided in the vicinity of the oil pump is also positioned relatively close to the cylinder block of the internal combustion engine, this water piping that makes the water jacket of the cylinder block and the water jacket of the oil cooler communicate with each other is allowed to be short, and it is possible to reduce of the number of parts and to reduce the weight.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, one embodiment according to the present invention is explained based on FIG. 1 to FIG. 14.

An internal combustion engine E according to the present embodiment constitutes a power unit P together with a power transmission apparatus in which a main transmission Tm and an auxiliary transmission Ts are combined, and is mounted on a roofed five-passenger all terrain vehicle 1 that is capable of four-wheel drive.

It should be noted that in the description of the specification and in the claims, the front, rear, left-right directions conform to a general rule that handles the advance direction of the all terrain vehicle 1 according to the present embodiment as the front direction.

The arrows FR, LH, RH, RR in the figures indicate the front direction, left direction, right direction, and rear direction of the vehicle respectively.

Figure 1:
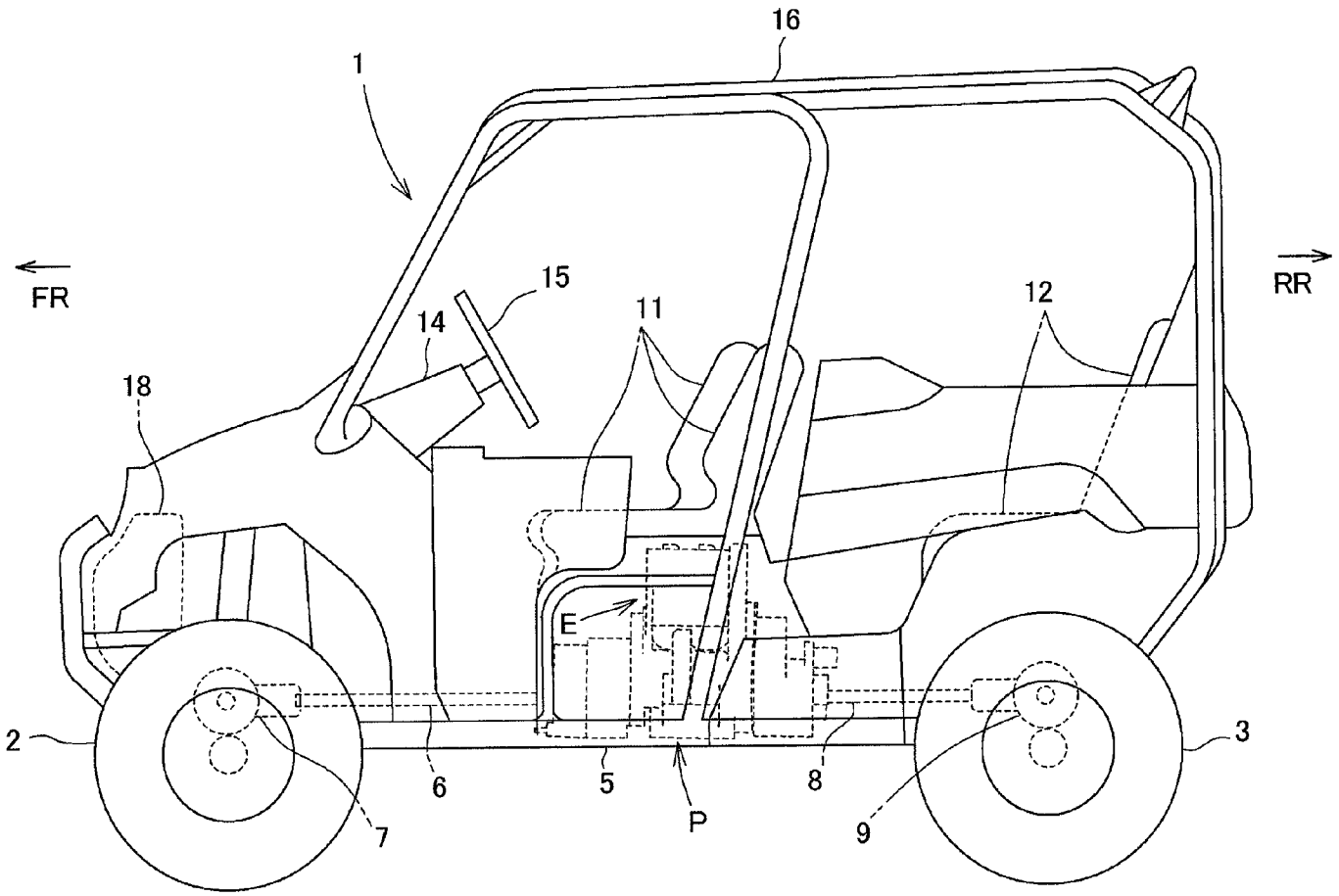
FIG. 1 is a side view of all terrain vehicle on which a water-cooled internal combustion engine according to one embodiment of the present invention is mounted.

As can be seen in FIG. 1, the all terrain vehicle 1 has a pair of left and right front wheels 2, 2 and a pair of left and right rear wheels 3, 3 around which low-pressure all terrain balloon tires are mounted. The front wheels 2, 2 and rear wheels 3, 3 are suspended at front and rear portions of a vehicle body frame 5.

The power unit P is mounted at a center position in the front-rear direction of the vehicle body frame 5, with a crankshaft 20 of the internal combustion engine E being oriented in the front-rear direction. An output shaft (not illustrated) of the power unit P protrudes in the front-rear direction with rotational power of the output shaft being transmitted from the front end of the output shaft to the left and right front wheels 2, 2 via a front drive shaft 6 and a front final reduction gear unit 7, and is transmitted from the rear end of the output shaft to the left and right rear wheels 3, 3 via a rear drive shaft 8 and a rear final reduction gear unit 9.

It should be noted that a clutch to connect and disconnect transmission of power to the front wheels 2, 2 to switch between two-wheel drive and four-wheel drive is incorporated in the front final reduction gear unit 7.

Above the power unit P, three front sheets 11 are placed side by side in the left-right direction, and at a rear part of the vehicle body frame 5, two rear seats 12 are placed in the left-right direction.

The central front sheet 11 is displaced slightly forward from the left and right seats.

A steering wheel 15 is provided before a driver seat on the left side, and protrudes from a steering column 14.

The front sheets 11 and the rear seats 12 are covered by a roof 16 from above.

The internal combustion engine E is a straight twin, water-cooled four-stroke internal combustion engine, and the power unit P is mounted on the vehicle body frame 5 in a so-called vertically placed posture in which the crankshaft 20 of this internal combustion engine E is oriented in the vehicle body front-rear direction.

A radiator 18 is supported at a front part of the vehicle body frame 5.

A crankcase 21 that journals the crankshaft 20 of the internal combustion engine E has a horizontally divided crankcase structure consisting of an upper crankcase 21U and a lower crankcase 21L. A cylinder block 22 extends obliquely rightward and upward out from the upper crankcase 21U, and thereabove, a cylinder head 23 and a cylinder head cover 24 are stacked sequentially and protrude therefrom (see FIG. 2 and FIG. 4).

The bottom of the lower crankcase 21L includes an oil pan 21P in which oil is collected.

Figure 4:
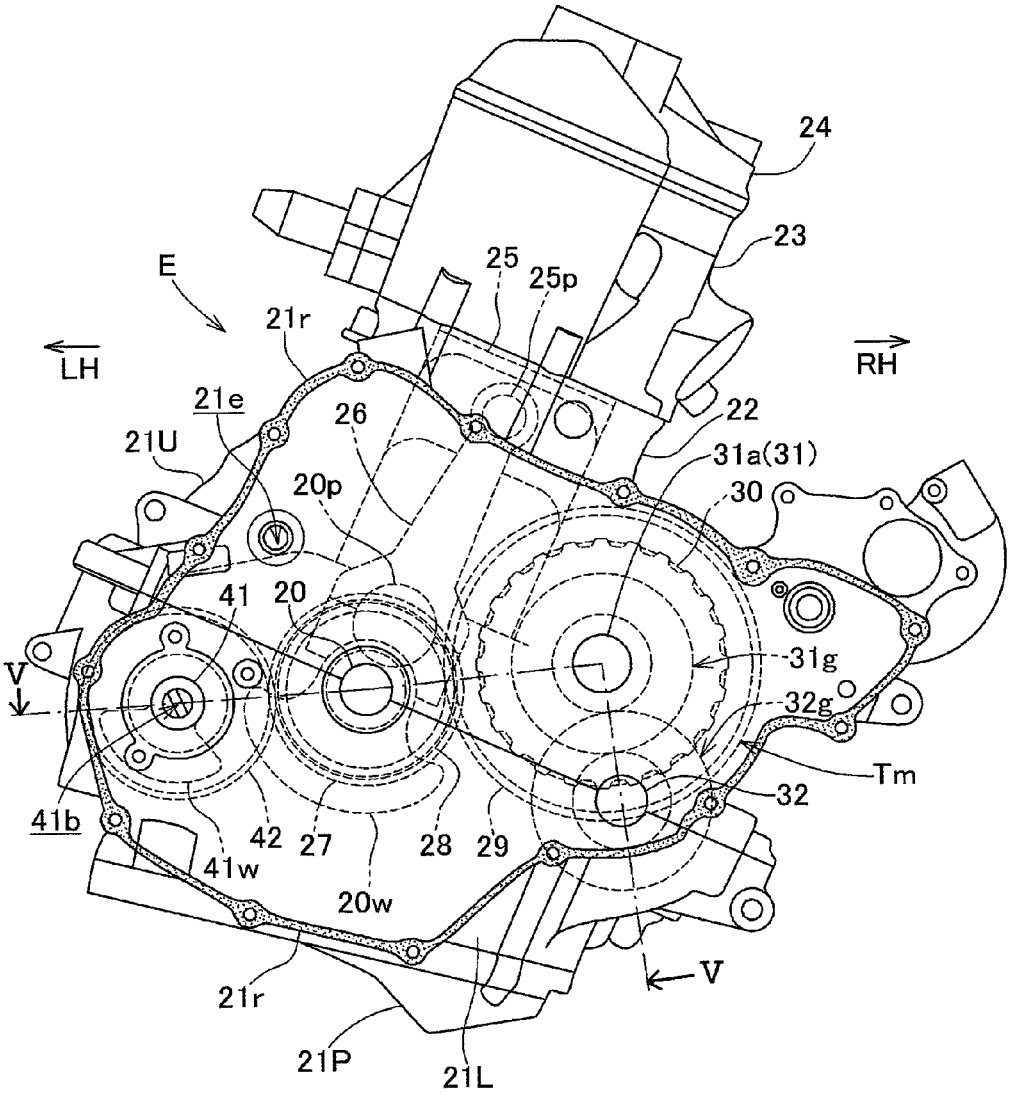
FIG. 4 is a rear view of an internal combustion engine with a spacer and the like being detached therefrom.

The crankcase 21 bulges rightward, and houses the main transmission Tm (see FIG. 4).

This main transmission Tm is positioned on the right side of the crankshaft 20 of the internal combustion engine E with the auxiliary transmission Ts being provided to approximately overlap a front area of the main transmission Tm and protrude therefrom.

FIG. 4 is a rear view of the internal combustion engine E from which members behind the crankcase 21 are omitted. A crank mechanism is structured with a piston 25 that is fitted into two front and rear cylinder bores of the cylinder block 22 respectively so that the piston 25 is reciprocatable and slidable. A connecting rod 26 interconnects a crank pin 20*p* between crank webs 20*w*, 20*w* of the crankshaft 20, and a piston pin 25*p* of the piston 25.

As shown in FIG. 4, when the internal combustion engine E is in a horizontal posture together with the vehicle body, the divisional surface between the horizontally divided upper crankcase 21U and lower crankcase 21L is inclined such that its right side is lowered. A countershaft 32 among a main shaft 31 and the countershaft 32 which are a pair of transmission axes of the main transmission Tm is placed on this inclined divisional surface together with the crankshaft 20. The crankshaft 20 and the countershaft 32 are journaled rotatably while being sandwiched between the upper crankcase 21U and the lower crankcase 21L. The main shaft 31 is journaled rotatably to the upper crankcase 21U above the countershaft 32.

On the other hand, on the left side of the crankshaft 20, a balancer shaft 41 is journaled to the lower crankcase 21L via bearings 40*f*, 40*r*.

The above-described main shaft 31, countershaft 32, and balancer shaft 41 are all parallel with the crankshaft 20 and oriented in the front-rear direction.

Figure 5:
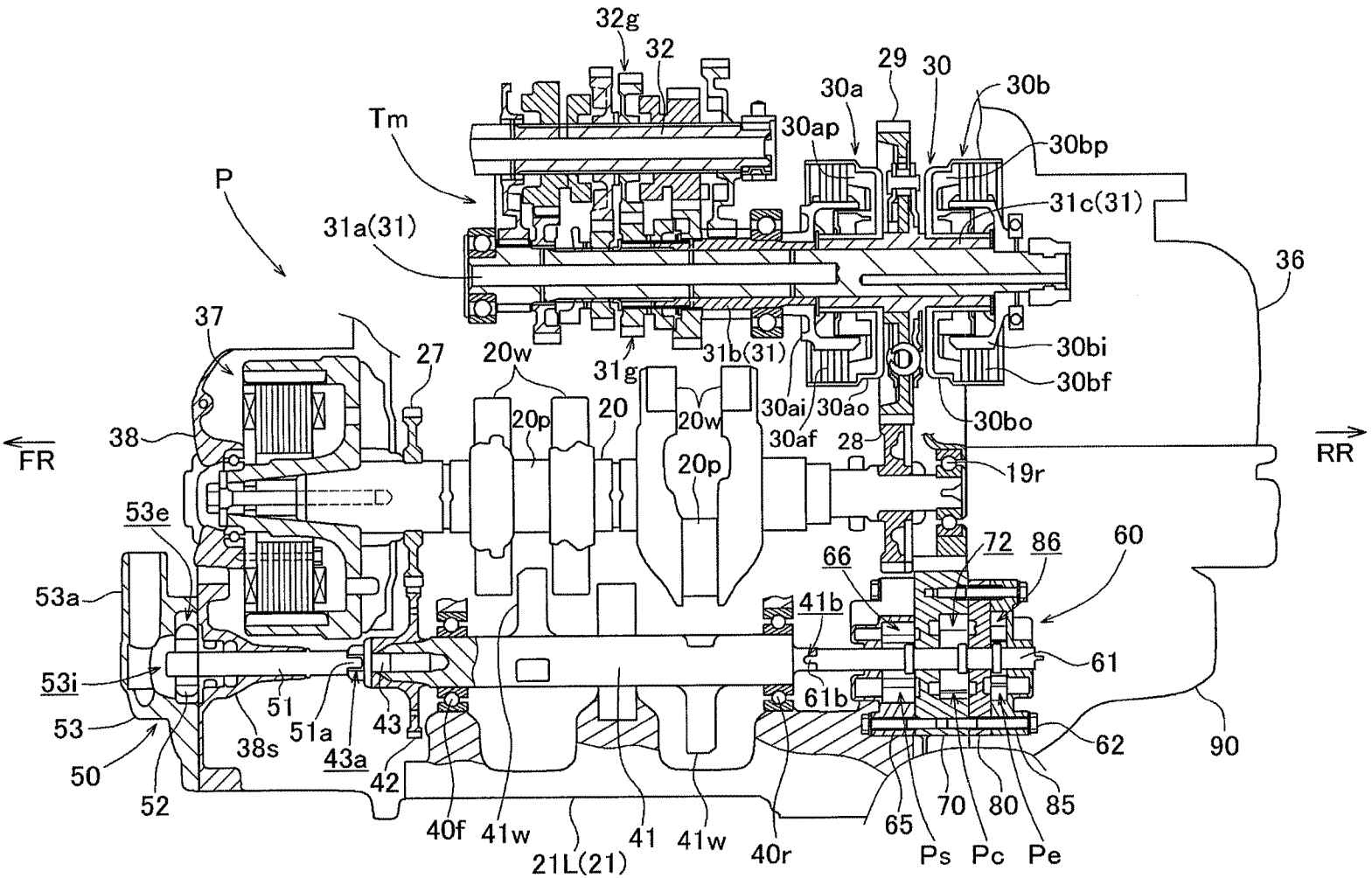
FIG. 5 is a cross-sectional view taken along the line indicated with the arrow V-V in FIG. 4 and FIG. 10.

As can be seen in FIG. 5, a pair of the crank webs 20*w*, 20*w* comprising counter weights for each cylinder is formed at front and rear parts of the crankshaft 20 that is oriented in the front-rear direction. An AC generator 37 is provided to the front end of the crankshaft 20 with a balancer drive gear 27 being fitted between the AC generator 37 and the crank web 20*w*.

A primary drive gear 28 is fitted behind the crank web 20*w* of the crankshaft 20.

As illustrated in FIG. 5, the main shaft 31 of the main transmission Tm is structured with the main shaft outer cylinder 31*b* and a clutch outer cylinder 31*c* being arranged in the front-rear direction and fitted rotatably at the outer periphery of a long main shaft inner cylinder 31*a*.

Six drive transmission gears 31*g* are provided to the main shaft 31, and corresponding to the drive transmission gears 31*g*, six driven shift gears 32*g* that mesh with them constantly are provided to the countershaft 32.

The drive transmission gears 31*g*, at odd-numbered shift positions, are provided to the main shaft inner cylinder 31*a*. The drive transmission gears 31*g*, at even-numbered shift positions, are provided to the main shaft outer cylinder 31*b*.

A pair of twin clutches 30 consisting of a first clutch 30*a* and a second clutch 30*b* are structured on the clutch outer cylinder 31*c*. A primary driven gear 29 is provided at the center of the clutch outer cylinder 31*c*. Clutch outers 30*ao*, 30*bo* of the first clutch 30*a* and the second clutch 30*b* are provided to both sides of the primary driven gear 29 by spline fitting so that their movement in the axial direction is regulated.

The center primary driven gear 29 meshes with the primary drive gear 28 provided to the crankshaft 20.

The clutch inner 30*ai* of the first clutch 30*a* is spline-fitted to the main shaft inner cylinder 31*a* so that its movement in the axial direction is regulated with the clutch inner 30*bi* of the second clutch 30*b* being spline-fitted to the main shaft outer cylinder 31*b* so that its movement in the axial direction is regulated.

Pressurizing plates 30*ap* (30*bp*) can pressurize a friction plate group 30*af* (30*bf*) that is formed by arraying alternately drive friction plates that rotate together on the clutch outer 30*ao* (30*bo*) side and driven friction plates that rotate together on the clutch inner 30*ai* (30*bi*) side.

Figure 3:
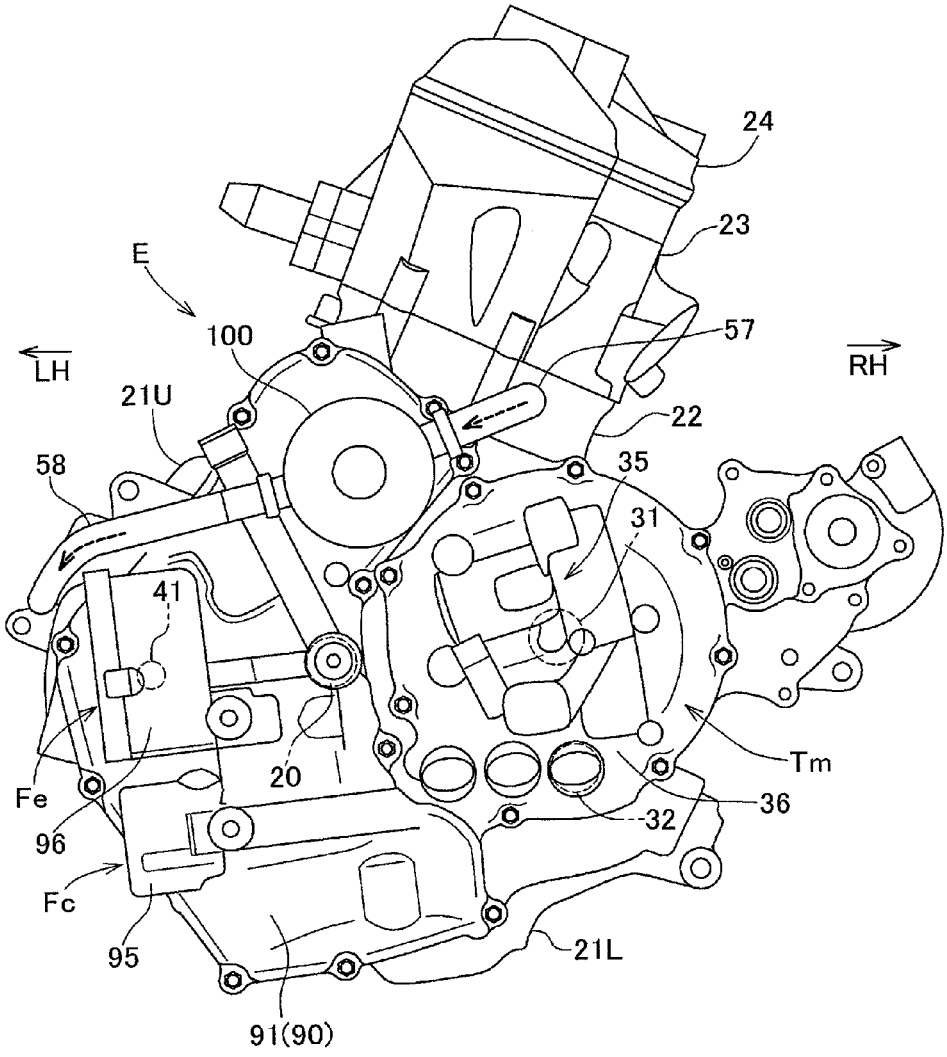
FIG. 3 is a rear view of an internal combustion engine.

A hydraulic circuit that drives the pressurizing plates 30*ap*, 30*bp* selectively is formed in the main shaft inner cylinder 31*a* and the clutch outer cylinder 31*c* with a hydraulic controller 35 being formed in the clutch cover 36 (see FIG. 3).

When the friction plate group 30*af* is pressurized when the pressurizing plate 30*ap* is driven by being controlled by the hydraulic controller 35, the first clutch 30*a* is connected, the power input to the primary driven gear 29 is transmitted to the main shaft inner cylinder 31*a*, and the drive transmission gears 31*g* at the odd-numbered shift positions rotate.

On the other hand, when the friction plate group 30*bf* is pressurized when the pressurizing plate 30*bp* is driven by switching control of the hydraulic controller 35, the second clutch 30*b* is connected, the power input to the primary driven gear 29 is transmitted to the main shaft outer cylinder 31*b*, and the drive transmission gears 31*g* of the even-numbered shift positions rotate.

As illustrated in FIG. 5, the balancer shaft 41 placed parallel on the left side of the crankshaft 20 comprises balancer weights 41*w*, 41*w* at front and rear portions thereof. The front-side balancer weight 41*w* and the rear balancer weight 41*w* are positioned such that the front-side balancer weight 41*w* revolves between the pair of crank webs 20*w*, 20*w* on the front side of the crankshaft 20, and the rear balancer weight 41*w* revolves between the pair of crank webs 20*w*, 20*w* on the rear side of the crankshaft 20.

A balancer driven gear 42 is fastened to a front end portion protruding forward from the bearing 34*f* of the balancer shaft 41 by a bolt 43 that is screwed to the front end surface of the balancer shaft 41.

The balancer driven gear 42 meshes with the balancer drive gear 27 provided to the crankshaft 20 with rotation of the crankshaft 20 being transmitted to the balancer shaft 41.

The balancer shaft 41 is rotatably driven at the same speed with and in the opposite direction to the crankshaft 20 for suppressing first order vibration due to the crank mechanism of the internal combustion engine E.

In front of this balancer shaft 41, a water pump 50 provided to an ACG cover 38 covering the AC generator 37 from the front is arranged at a predetermined position. A water pump drive shaft 51, journaled rotatably to a bearing cylindrical part 38*s* of the ACG cover 38, is placed coaxially with the balancer shaft 41.

A coupling recess 43*a* is formed in a head part of the bolt 43 screwed to the front end surface of the balancer shaft 41. A coupling projection 51*a* protruding backward from the rear end of the water pump drive shaft 51 is fitted to and coupled with the coupling recess 43*a* of the head part of the bolt 43 at the front end of the balancer shaft 41. Thereby, rotation of the balancer shaft 41 is transmitted to the water pump drive shaft 51 and the water pump 50 is driven.

A water pump body 53 is attached in front of the bearing cylindrical part 38*s* of the ACG cover 38. In the water pump body 53, an impeller 52 fixed to the water pump drive shaft 51 is housed, and a suction port 53*i* and a discharge port 53*e* are formed.

Figure 2:
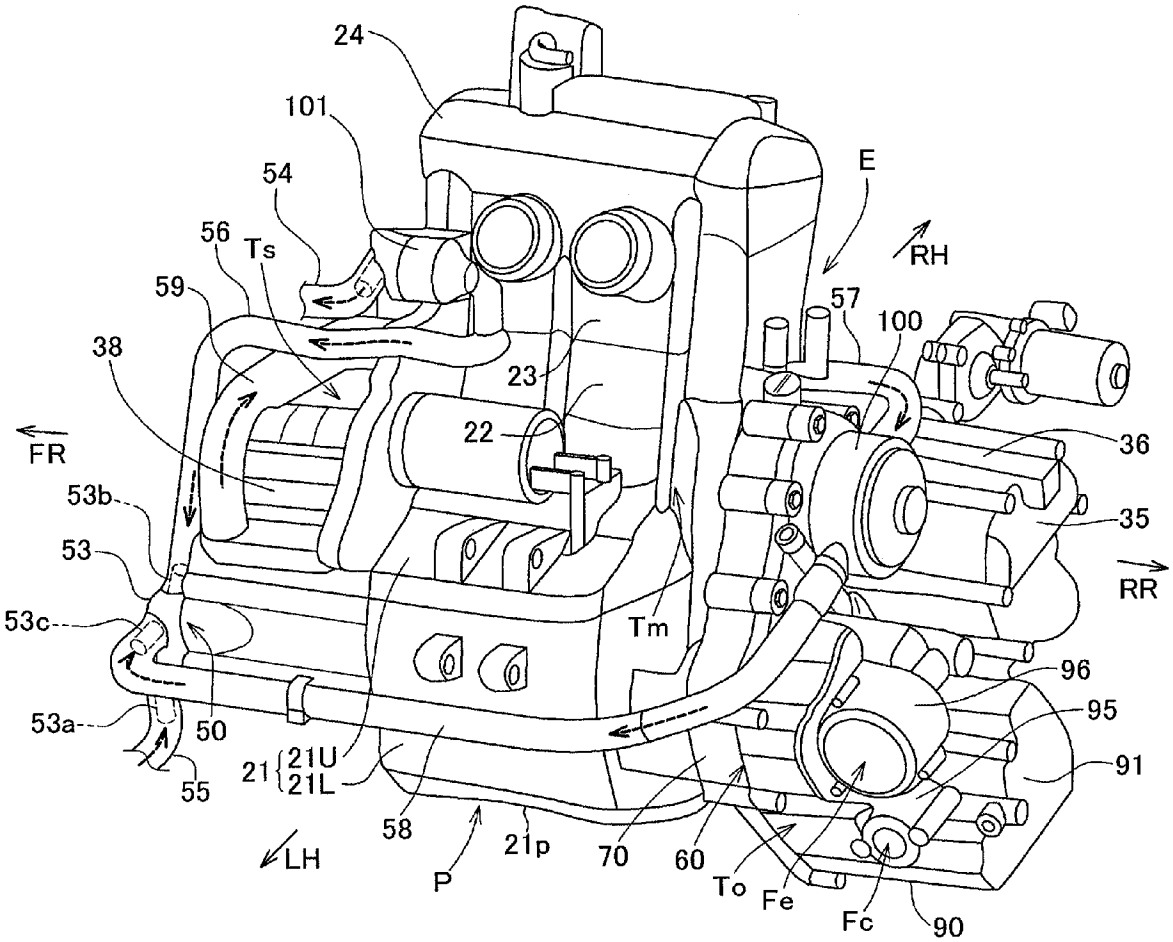
FIG. 2 is an overall perspective view of a power unit as seen from obliquely behind it.

In addition, suction connecting pipes 53*a*, 53*b*, 53*c* extend in three directions out from the suction port 53*i* (see FIG. 2).

As shown in FIG. 4, the rear surfaces of the mutually combined upper crankcase 21U and lower crankcase 21L have a space that is largely surrounded by rear circumferential walls 21*r*, 21*r* protruding rearwardly with the end surfaces of the rear circumferential walls 21*r*, 21*r* forming the same vertical aligning surface.

The rear-side engine case cover 90 and the clutch cover 36 cover, from behind, these end surfaces of the rear circumferential walls 21*r*, 21*r* via a spacer 70 (see FIG. 3 and FIG. 5).

An oil pump unit 60 is provided behind the balancer shaft 41 by being supported by the spacer 70.

The clutch cover 36 covers, from behind, the twin clutches 30 on the right side of the crankshaft 20, and the rear-side engine case cover 90 covers, from behind, the left side of the crankcase 21 including the crankshaft 20 and the oil pump unit 60 on the left side of the crankshaft 20.

A dry sump method is adopted for lubrication of the present power unit P, and the oil pump unit 60 is formed by integrating a scavenging pump Ps that pumps up oil to an oil tank To; a clutch oil pump Pc that pressure-feeds oil from the oil tank To to the hydraulic twin clutches 30; and an engine oil pump Pe that supplies oil to each lubrication portion of the internal combustion engine E into a unit.

As can be seen in FIG. 5, the scavenging pump Ps, the clutch oil pump Pc and the engine oil pump Pe are all trochoid pumps that have a shared oil pump drive shaft 61. Each rotor is attached to the oil pump drive shaft 61.

This shared oil pump drive shaft 61 of these three oil pumps Ps, Pc, Pe is positioned coaxially behind the balancer shaft 41. A coupling projection 61*b* protruding from the front end of the oil pump drive shaft 61 and a coupling recess 41*b* formed at the rear end of the balancer shaft 41 are fitted and coupled. Thereby, rotation of the balancer shaft 41 is transmitted to the oil pump drive shaft 61, and three oil pumps Ps, Pc, and Pe are driven simultaneously.

Figure 6:
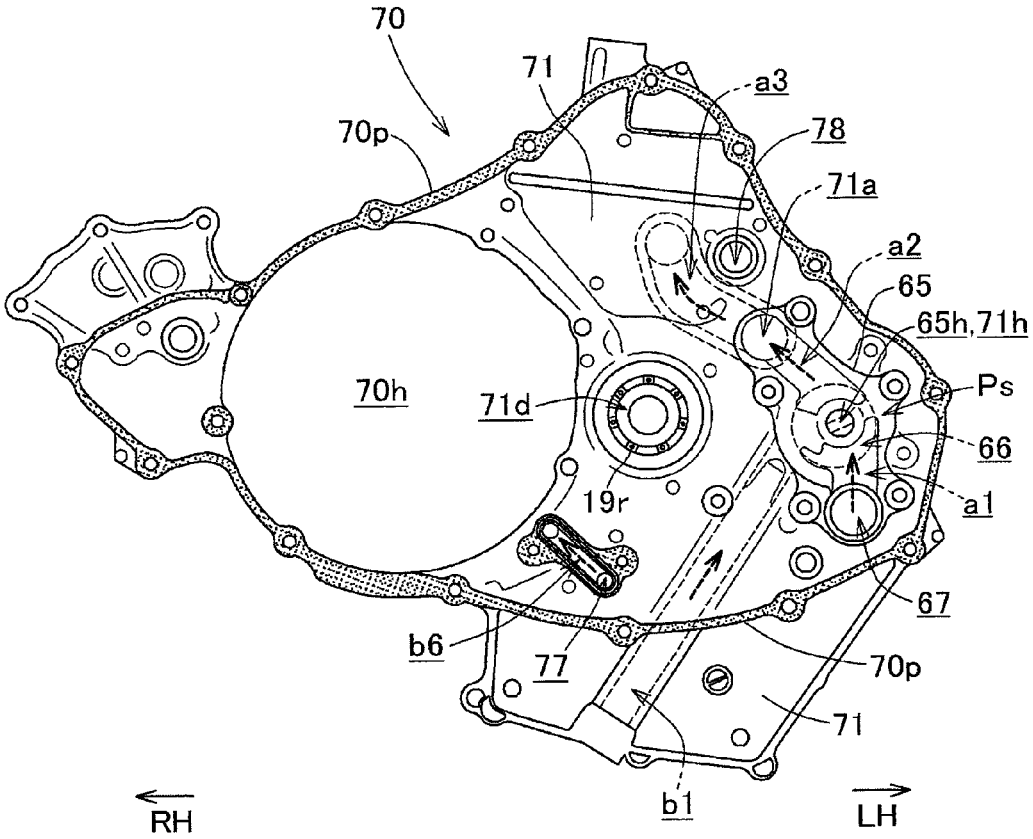
FIG. 6 is a front view of a spacer to which a scavenging pump body is attached.
Figure 7:
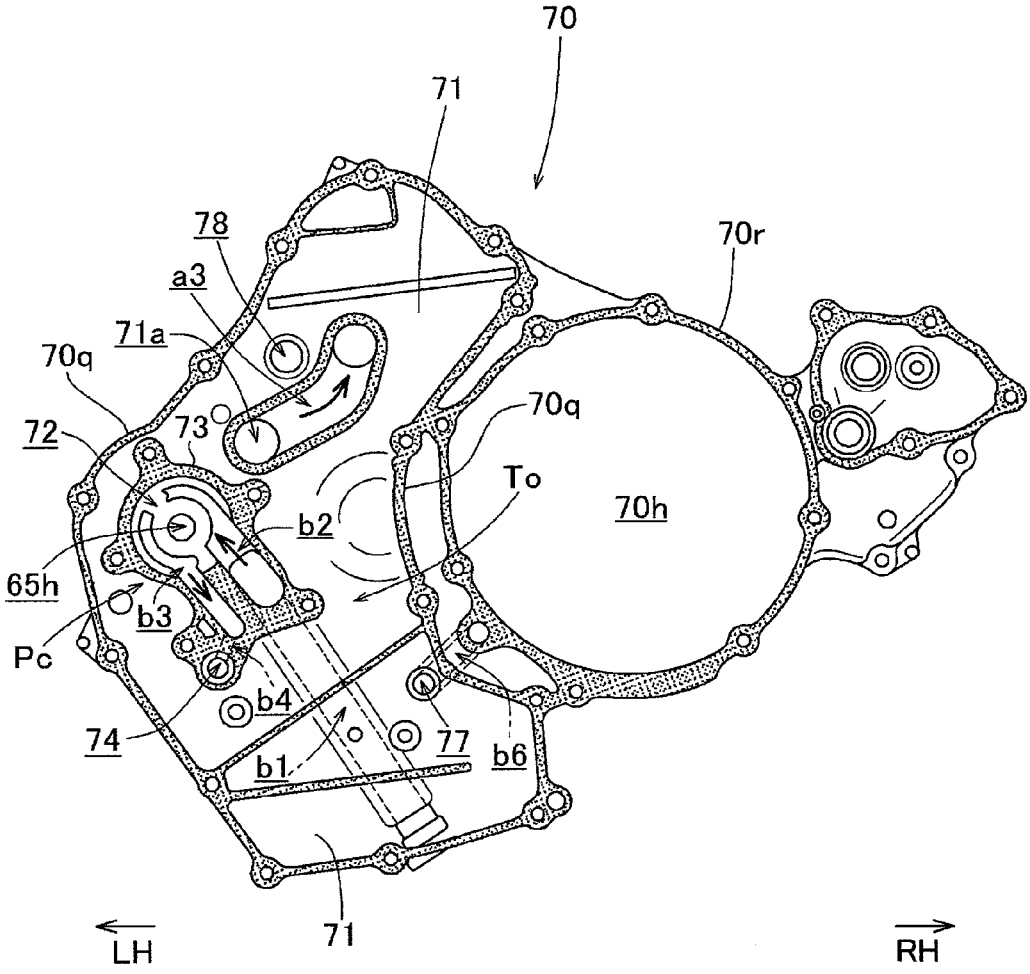
FIG. 7 is a rear view of the spacer.

As illustrated in FIG. 6 and FIG. 7, in the spacer 70 to which this oil pump unit 60 is provided, a front circumferential wall 70*p* corresponding to a rear circumferential wall 21*r* of the crankcase 21 is formed to protrude forward as shown in the front view shown in FIG. 6.

In the front circumferential wall 70*p*, the left side is closed by a sidewall 71, and a large circle opening 70*h* is formed on the right side.

The twin clutches 30 are inserted to the circle opening 70*h*.

In the front view shown in FIG. 6, there is a bearing recess 71*d* that bears the rear end of the crankshaft 20 at the approximate center on the sidewall 71 of the spacer 70, and a bearing 19*r* that journals the crankshaft 20 in the bearing recess 71*d* rotatably is fitted thereto (see FIG. 5).

At a farther position on the left side of the bearing recess 71*d* on the sidewall 71 of the spacer 70, a bearing hole 71*h*, that journals the oil pump drive shaft 61, is formed.

On the front surface of the sidewall 71 of the spacer 70, an oil groove of a suction oil passage a1 is formed below the bearing hole 71*h*, an oil groove of a discharge oil passage a2 is formed obliquely above the bearing hole 71*h*, and a scavenging pump body 65 is attached thereon so as to cover it.

FIG. 6 shows a state where the scavenging pump body 65 is attached to the sidewall 71 of the spacer 70.

The scavenging pump body 65 has a bearing hole 65*h* that is coaxial with the bearing hole 71*h* on the sidewall 71 of the spacer 70, a scavenging pump chamber 66 to house a rotor is formed therein, an oil groove forming the suction oil passage a1 is formed to extend downward out from the scavenging pump chamber 66, and an oil groove forming a discharge oil passage a2 is formed to extend obliquely upwardly out from the scavenging pump chamber 66; thereby, the scavenging pump Ps is structured (see FIG. 6).

At the upstream end of the suction oil passage a1 of the scavenging pump body 65, a coupling port 67 opens in a forward direction. Although not illustrated in FIG. 6, a passage to pump up oil from the oil pan 21P via the strainer 63 is coupled to this coupling port 67 (see FIG. 13).

Also, at the downstream end of the discharge oil passage a2, a communication port 71*a* formed on the sidewall 71 of the spacer 70 opens rearwardly.

In the rear view of the spacer 70 shown in FIG. 7, the sidewall 71 of the spacer 70 extends out more downwardly than the front circumferential wall 70*p*, a rear circumferential wall 70*q* protrudes rearwardly along the contour of this sidewall 71, and a rear circle circumferential wall 70*r* is formed to protrude rearwardly along the inner peripheral edge of the circle opening 70*h*.

The end surfaces of the rear circumferential wall 70*q* and the rear circle circumferential wall 70*r* form the same vertical aligning surface.

The oil tank To is formed inside the rear circumferential wall 70*q* protruding rearwardly along the contour of the sidewall 71.

An oil groove forming the oil passage a3 is formed on the rear surface of the sidewall 71 of the spacer 70 obliquely upwardly from the backward-penetrating communication port 71*a*.

Also, on the rear surface of the sidewall 71 of the spacer 70, a clutch oil pump chamber 72 housing a rotor therein is formed around the bearing hole 65*h* with an oil groove of a suction oil passage b2 and an oil groove of a discharge oil passage b3 being formed to extend in parallel obliquely downward out from the clutch oil pump chamber 72. Thus, the clutch oil pump Pc is structured (see FIG. 7).

An oil passage b1 is formed on the sidewall 71 of the spacer 70, from the upstream end of the suction oil passage b2 to the vicinity of the lowest portion of the rear circumferential wall 70*q* (the bottom wall of the oil tank To).

The lower end of the oil passage b1 opens rearwardly, that is, opens into the oil tank To, and the upper end of the oil passage b1 communicates with the suction oil passage b2.

Figure 13:
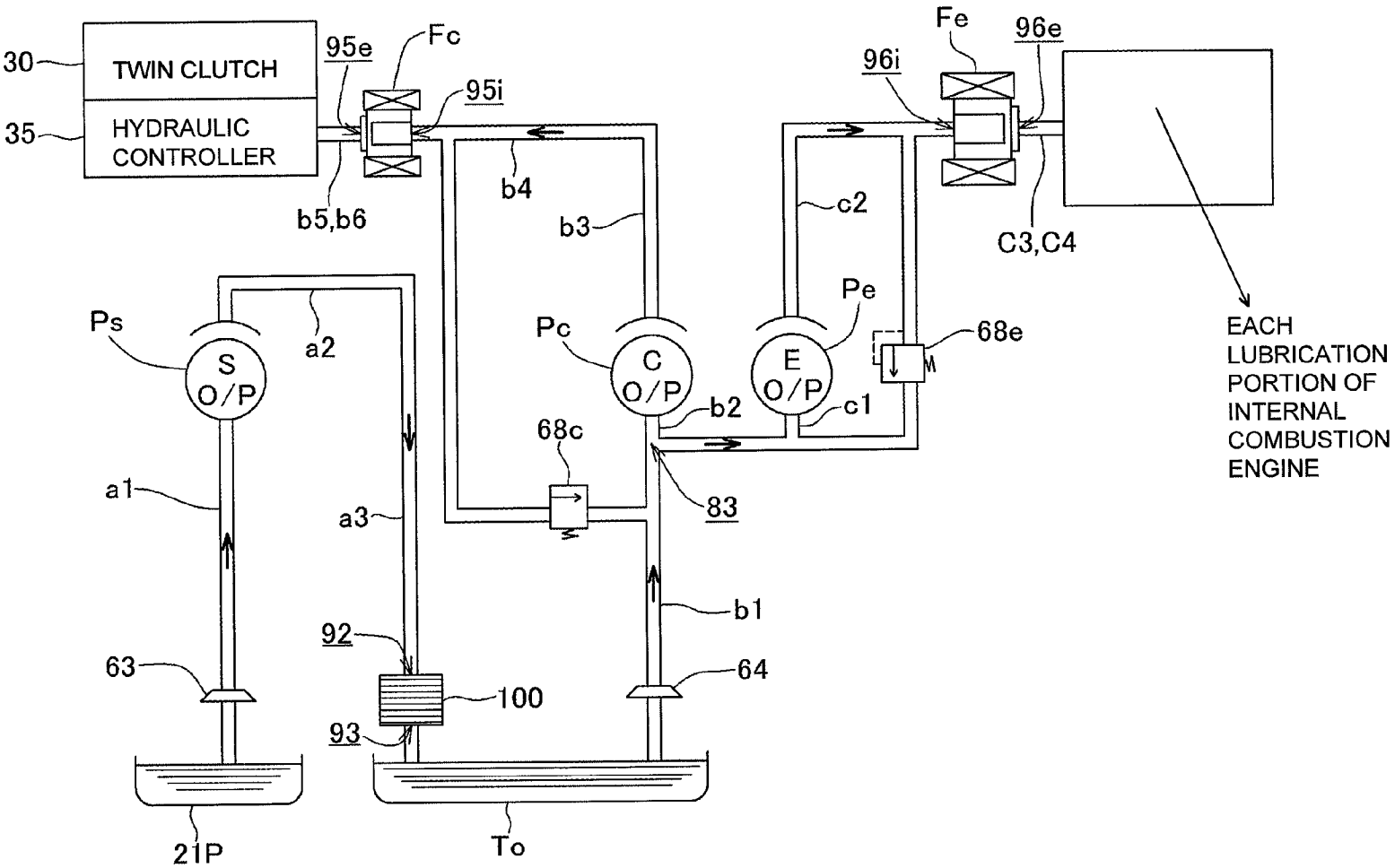
FIG. 13 is a schematic view of an oil circulation path of an oil supply structure in the present water-cooled internal combustion engine.

A strainer 64 is interposed in the oil passage b1 (see FIG. 13).

A plate-like oil pump plate 80 abuts on the end surface of a frame wall 73 forming the clutch oil pump chamber 72 and each oil groove of the suction oil passage b2 and the discharge oil passage b3.

Figure 8:
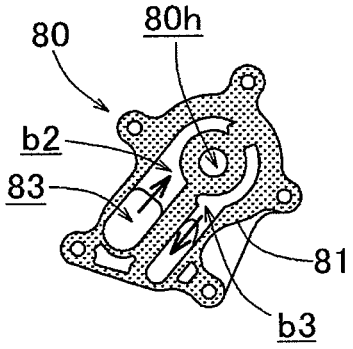
FIG. 8 is a front view of an oil pump plate.
Figure 9:
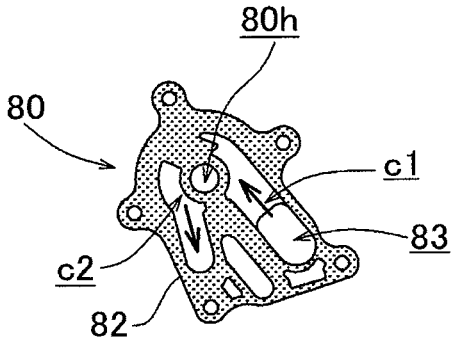
FIG. 9 is a rear view of the oil pump plate.

The front view and rear view of the oil pump plate 80 are shown in FIG. 8, and FIG. 9, respectively.

A bearing hole 80*h* that journals the oil pump drive shaft 61 penetrates through the oil pump plate 80. On its front surface, a front frame wall 81 corresponding to the end surface of the frame wall 73 of the spacer 70 is formed (see FIG. 8). By combining the oil pump plate 80, the clutch oil pump chamber 72, the suction oil passage b2, and discharge oil passage b3 are formed.

It should be noted that as shown in FIG. 7, the oil passage b4 that bends rearwardly after perforation into the sidewall 71 of the spacer 70 obliquely downward communicates with the downstream end of the discharge oil passage b3, and the oil passage b4 opens at the coupling port 74 rearwardly.

The oil pump plate 80 covers the end surface of the frame wall 73 except for the coupling port 74 of the oil passage b4.

As shown in FIG. 9, on the rear surface of the oil pump plate 80, each oil groove of a suction oil passage c1 and a discharge oil passage c2 is formed by a rear frame wall 82 from the vicinity of the bearing hole 80*h*, and the upstream end of the suction oil passage c1 communicates with the upstream end of the suction oil passage b2 on the front surface via a communication port 83.

Accordingly, oil that enters the suction oil passage b2 of the clutch oil pump Pc from a bottom portion of the oil tank To through the oil passage b1 is branched by the communication port 83 and is also sucked into the suction oil passage c1.

An engine oil pump body 85 covers, from behind, this rear surface of the oil pump plate 80.

Figure 10:
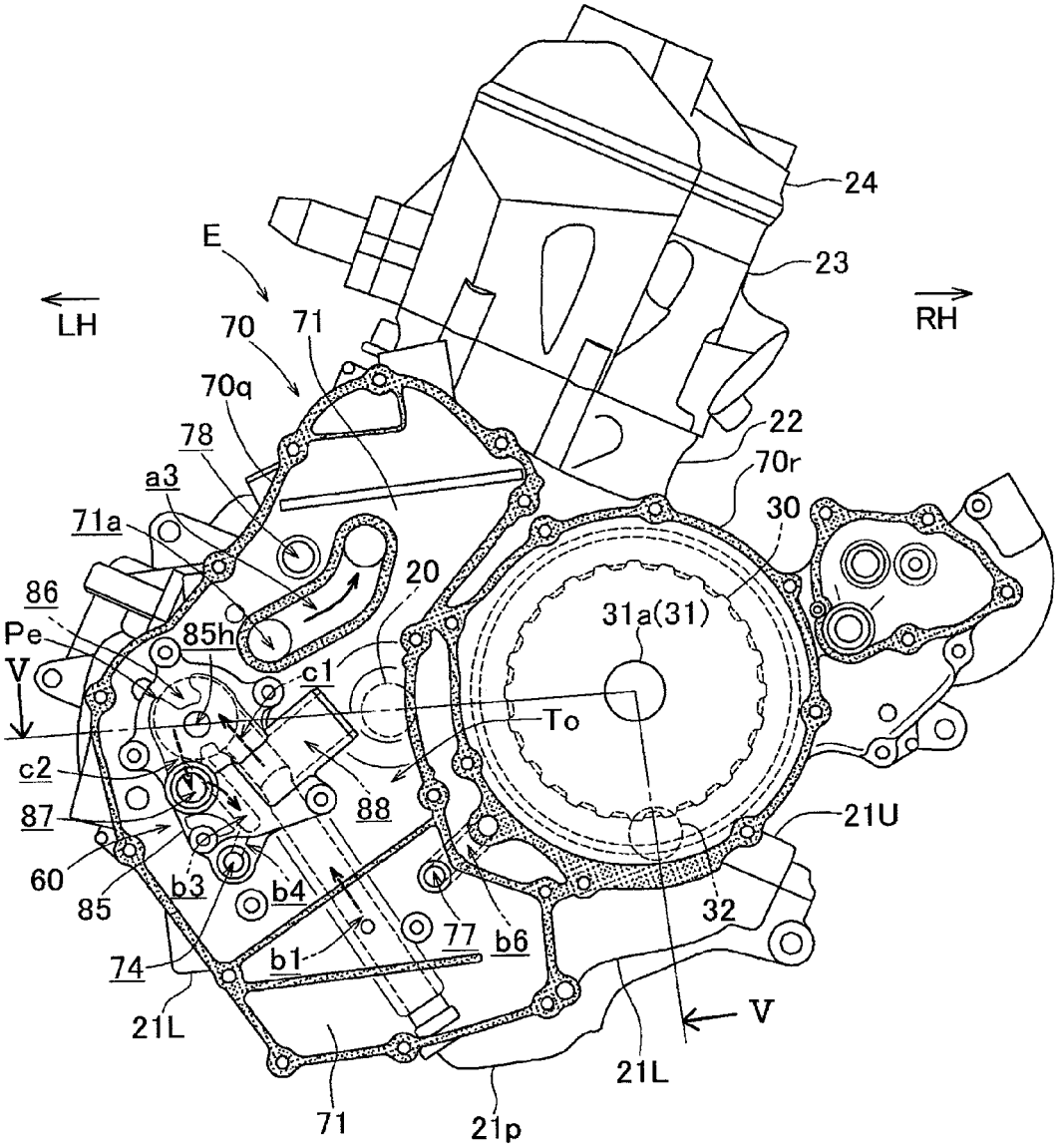
FIG. 10 is a rear view of an internal combustion engine with a spacer and the like being attached to a crankcase.

As can be seen in FIG. 10, a bearing hole 85*h* that journals the oil pump drive shaft 61 penetrates through the engine oil pump body 85, the engine oil pump chamber 86 housing a rotor therein is formed, and each oil groove of the suction oil passage c1 and the discharge oil passage c2 is formed to extend obliquely downwardly out from the engine oil pump chamber 86. Thus, the engine oil pump Pe is structured.

At the downstream end of the discharge oil passage c2 of the engine oil pump body 85, a coupling port 87 opens rearwardly.

At the upstream end of the suction oil passage c1 of the engine oil pump body 85, a relief passage 88 in which a relief valve 68*e* is interposed is formed.

It should be noted that the coupling port 74 of the oil passage b4 of the spacer 70 is exposed downwardly along the engine oil pump body 85.

In this manner, as shown in FIG. 5, by stacking the scavenging pump body 65 on the front surface of the spacer 70 with a rotor being incorporated therein, sequentially stacking the oil pump plate 80 and the engine oil pump body 85 on the rear surface of the spacer 70 each with a rotor being incorporated therein, and fastening integrally with a plurality of fastening bolts 62 in a state where the oil pump drive shaft 61 is penetrating therethrough, the oil pump unit 60, formed by integrating the scavenging pump Ps, the clutch oil pump Pc, and the engine oil pump Pe into a unit, is structured, and is provided by being supported on the spacer 70.

FIG. 10 shows a state where the spacer 70 provided with the oil pump unit 60 is attached to the rear surface of the crankcase 21 of the internal combustion engine E.

A rear-side engine case cover 90 covers the sidewall 71 of this spacer 70 from behind.

Figure 11:
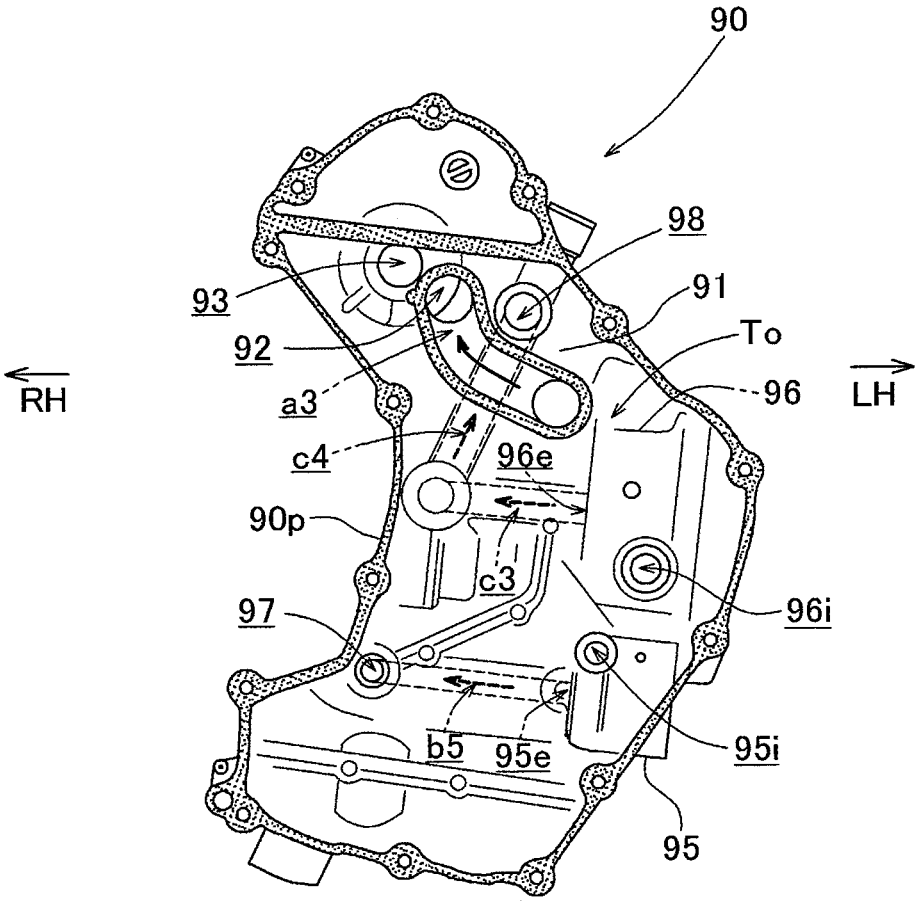
FIG. 11 is a front view of a rear-side engine case cover.
Figure 12:
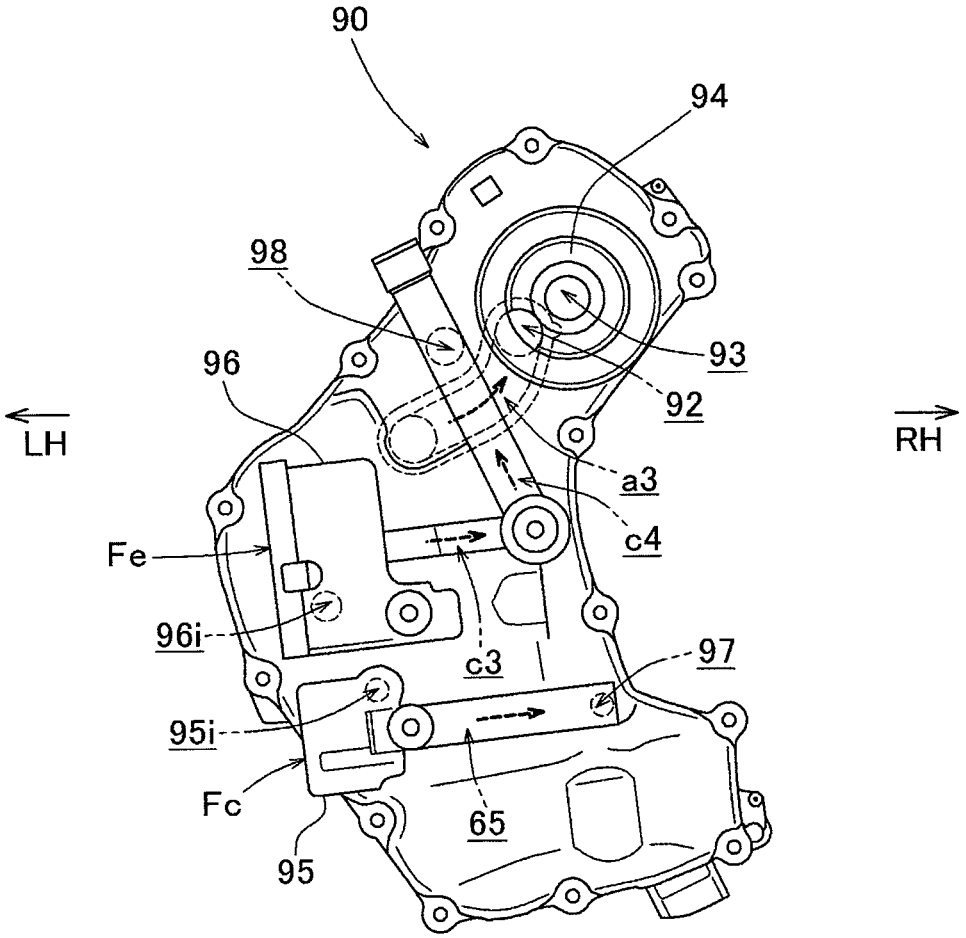
FIG. 12 is a rear view of the rear-side engine case cover.

The front view and rear view of the rear-side engine case cover 90 are shown in FIG. 11 and FIG. 12, respectively.

In the rear-side engine case cover 90, a front circumferential wall 90*p* corresponding to the rear circumferential wall 70*q* along the contour of the sidewall 71 of the spacer 70 is formed to protrude forward from a sidewall 91, and when the rear circumferential wall 70*q* on the sidewall 71 of the spacer 70 and the front circumferential wall 90*p* of the rear-side engine case cover 90 are coupled, the oil tank To is formed between the sidewall 71 of the spacer 70 and the sidewall 91 of the rear-side engine case cover 90 by being surrounded by the rear circumferential wall 70*q* and the front circumferential wall 90*p*.

An oil groove corresponding to the oil groove formed on the rear surface of the spacer 70 is formed at an upper portion on the front surface of the sidewall 91 of the rear-side engine case cover 90, and by combining both of them, the oil passage a3 is structured.

At the downstream end of the oil groove that constitutes the oil passage a3 on the sidewall 91 of the rear-side engine case cover 90, a cooler inlet 92 opens in a forward direction.

A cooler outlet 93 is formed obliquely above this cooler inlet 92.

On the rear surface of the sidewall 91 of the rear-side engine case cover 90, an attachment surface 94 of the oil cooler 100 is formed circularly centering on the cooler outlet 93 (see FIG. 12).

The cooler inlet 92 is also formed on the attachment surface 94.

When the flat cylindrical oil cooler 100 is attached to the attachment surface 94 on the sidewall 91 of the rear-side engine case cover 90, oil that has flown from the cooler inlet 92 into the oil core of the oil cooler 100 is cooled, and flows out from the cooler outlet 93 into the oil tank To.

As shown in FIG. 11, because the cooler outlet 93 opens at an upper part of the oil tank To, oil cooled by the oil cooler 100 is caused to fall from a high position of the oil tank To onto oil collected in the oil tank To.

As illustrated in FIG. 12, on the sidewall 91 of the rear-side engine case cover 90, a filter housing 95 of the clutch oil filter Fe and a larger filter housing 96 of the engine oil filter Fe are formed to bulge rearwardly.

At a position that is at central height on the sidewall 91 of the rear-side engine case cover 90, and at a position that is at approximately the same height as the oil pump unit 60, a filter housing 96 of the engine oil filter Fe is formed in a cylindrical shape whose central axis is oriented approximately in the left-right direction, and below this filter housing 96, a smaller filter housing 95 of the clutch oil filter Fc is formed in a cylindrical shape whose central axis is oriented approximately in the left-right direction.

Filter elements are housed annularly in the filter housings 95, 96.

As can be seen in FIG. 10 and FIG. 11, on the front surface of the sidewall 91 of the rear-side engine case cover 90, a filter inlet 95*i* is formed to face the coupling port 74 opening rearwardly from the oil passage b4 of the spacer 70, and a filter inlet 96*i* is formed to face the coupling port 87 opening backward from the discharge oil passage c2 of the engine oil pump body 85.

Filter outlets 95*e*, 96*e* open at the center on bottom walls that are positioned on the respective right sides of the filter housings 95, 96, and oil passages b5, c3 are formed to the right from the filter outlets 95*e*, 96*e*.

The downstream end of the oil passage b5 opens forward as the coupling port 97, and a coupling port 77 is formed rearwardly on the sidewall 71 of the spacer 70 to face the coupling port 97 (see FIG. 10).

As shown in FIG. 10, from the coupling port 77, an oil passage b6 is formed toward the rear circle circumferential wall 70*r* through which the twin clutches 30 are inserted, and from the oil passage b6, an oil passage (not illustrated) that reaches the hydraulic controller 35 through the clutch cover 36 in which the twin clutches 30 is housed is formed.

On the other hand, as shown in FIG. 11, the oil passage c3 extending to the right out from the filter outlet 96*e* bends and extends out obliquely upwardly as an oil passage c4, and the oil passage c4 bends rearwardly at the upper end, and opens rearwardly as a coupling port 98.

A coupling hole 78 is formed on the sidewall 71 of the spacer 70 to face the coupling port 98 at the downstream end of the oil passage c4 (see FIG. 10).

The coupling hole 78 penetrates the sidewall 71 of the spacer 70, a coupling port 21*e* corresponding to the coupling hole 78 is formed in the upper crankcase 21U (see FIG. 4), and the coupling port 21*e* communicates with each lubrication portion of the internal combustion engine E.

The oil supply structure with the three oil pumps Ps, Pc, Pe of the oil pump unit 60 provided in the rear of the balancer shaft 41 of the present water-cooled internal combustion engine E is structured in this manner, a schematic view of the oil circulation path of the oil supply structure is shown in FIG. 13, and it is sorted out based on FIG. 13.

The scavenging pump Ps pumps up oil collected in the oil pan 21P to the suction oil passage a1 via the strainer 63, and discharges it to the discharge oil passage a2. The discharged oil is guided to the oil passage a3 to flow from the cooler inlet 92 into the oil cooler 100, and the oil cooled by the oil cooler 100 flows out from the cooler outlet 93 into the oil tank To.

The clutch oil pump Pc pumps up oil collected in the oil tank To to the suction oil passage b2 from the oil passage b1 via the strainer 64, and discharges it to the discharge oil passage b3. The discharged oil is guided to the oil passage b4 and flows from the filter inlet 95*i* into the clutch oil filter Fc, and the oil purified by the clutch oil filter Fc flows out from the filter outlet 95*e*, is guided to the oil passages b5, b6, and is supplied to the hydraulic controller 35 and the twin clutches 30.

It should be noted that a relief valve 68*c* is interposed between the upstream side and downstream side of the clutch oil pump Pc.

The engine oil pump Pe pumps up oil collected in the oil tank To to the suction oil passage c1 from the oil passage b1 via the strainer 64 after branching it at the communication port 83, and discharges it to the discharge oil passage c2. The discharged oil flows from the filter inlet 96*i* into the engine oil filter Fe, and the oil purified by the engine oil filter Fe flows out of the filter outlet 96*e*, is guided to the oil passages c3, c4, and is supplied to each lubrication portion of the internal combustion engine E.

It should be noted that the relief valve 68*e* is interposed between the upstream side and downstream side of the engine oil pump Pe.

The water pump 50 of the cooling system in the present water-cooled internal combustion engine E is provided in front of the balancer shaft 41 placed on the left side of the crankshaft 20. As illustrated in FIG. 2, the water pump body 53 is attached on the left side of the ACG cover 38 that covers the crankcase 21 from front, while the oil cooler 100 is attached at an upper part on the sidewall 91 of the rear-side engine case cover 90 that covers the crankcase 21 from behind.

A thermostat 101 is provided to the left side of a front part of the cylinder head 23.

As can be seen in FIG. 2, the thermostat 101 communicates, on its inflow side, with the water jacket of the cylinder head 23, and the outflow side of an open/close valve of the thermostat 101 and an inflow side tank of the radiator 18 placed at a front area of the vehicle are coupled by the radiator hose 54.

The suction connecting pipes 53*a*, 53*b*, 53*c* extend out to the suction port 53*i* of the water pump body 53, and among them, the suction connecting pipe 53*a* is coupled with an outflow side tank of the radiator 18 by the radiator hose 55.

The suction connecting pipe 53*b* is connected to an outflow connecting pipe of the thermostat 101 provided on left side of a front part of the cylinder head 23 by a bypass water pipe 56, and the suction connecting pipe 53*c* is coupled with the oil cooler 100 attached to the rear-side engine case cover 90 behind the crankcase 21 by the cooler outflow water pipe 58, and communicates with the water jacket of the oil cooler 100.

The water jacket of the oil cooler 100 and the water jacket of the cylinder block 22 are coupled by a cooler inflow water pipe 57.

Because the cooler inflow water pipe 57 extends out from the right side of a rear part of the cylinder block 22 close to the oil cooler 100, it is laid as a short pipe.

The discharge port 53*e* of the water pump body 53 of the water pump 50 communicates with a waterway within the wall of the ACG cover 38, and the waterway of the ACG cover 38 and the water jacket of the cylinder block 22 are coupled by a pump outflow water pipe 59.

Figure 14:
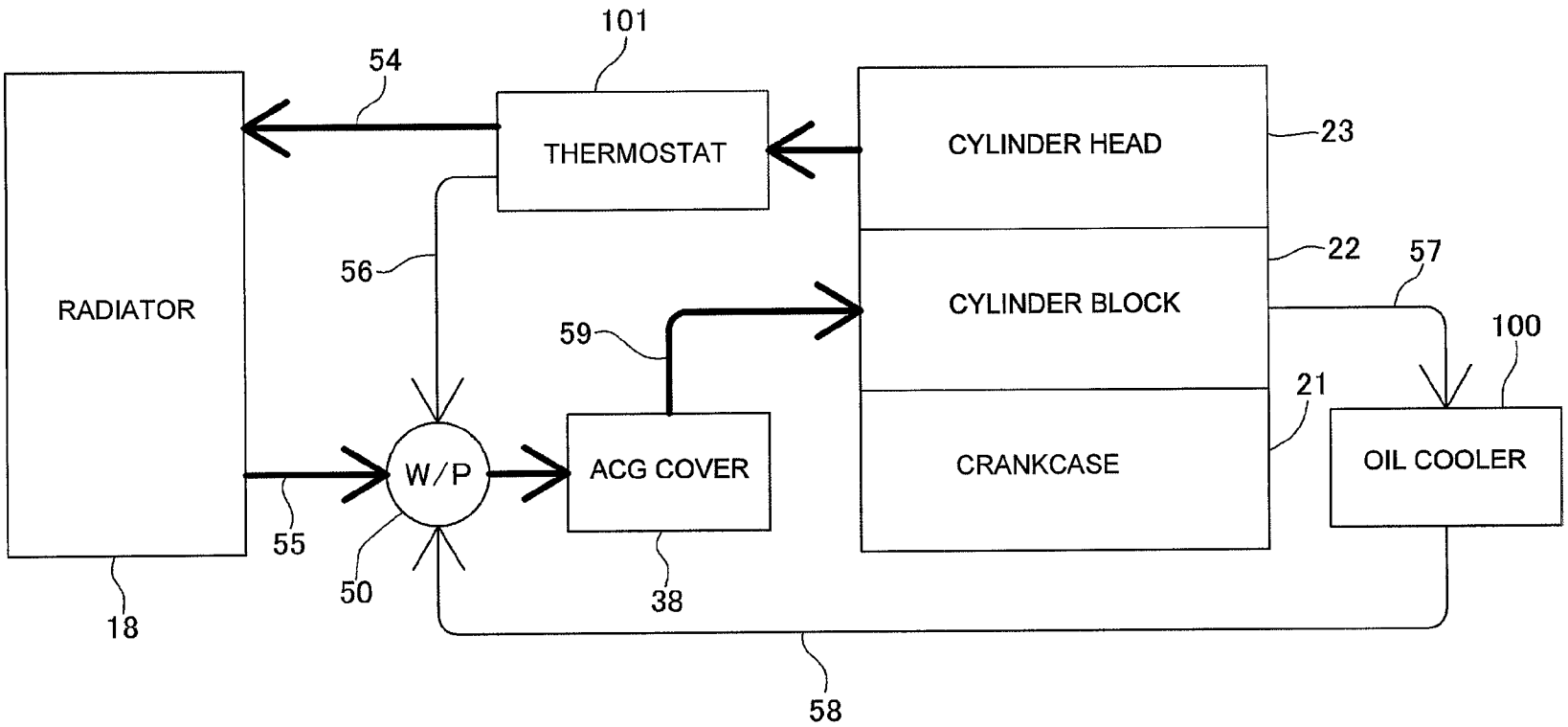
FIG. 14 is a schematic view of a water circulation path of a cooling system in the present water-cooled internal combustion engine.

A schematic view of the water circulation path of this cooling system is shown in FIG. 14.

Cooling water that has protruded from the water pump 50 flows into the water jacket of the cylinder block 22 through the ACG cover 38 by the pump outflow water pipe 59, circulates to the water jacket of the cylinder head 23 that communicates thereon, and cools the cylinder block 22 and the cylinder head 23. When the temperature of the cooling water is predetermined temperature or higher due to the thermostat 101, the cooling water flows from the water jacket of the cylinder head 23 to the radiator 18 by the radiator hose 54, is cooled by the radiator 18, and is caused to return to the water pump 50 by the radiator hose 55.

When the temperature of the cooling water is lower than a predetermined temperature because it is during warm-up operation or for other reasons, the thermostat 101 takes a circulation route which returns directly to the water pump 50 by the bypass water pipe 56 without passing through the radiator 18.

In addition to such a main circulation route of cooling water, the present water-cooled internal combustion engine E has a route that circulates trough the oil cooler 100 for adjusting the temperature of oil of the lubrication system. Part of cooling water flows by being branched into the water jacket of the oil cooler 100 by the cooler inflow water pipe 57 that branches and extends out from the water jacket of the cylinder block 22, adjusts the temperature of oil flowing the oil core at a required temperature, and is caused to return to the water pump 50 by the cooler outflow water pipe 58.

As described above, because the present water-cooled internal combustion engine E has a structure in which the oil pump drive shaft 61 of the oil pump unit 60 is coaxially coupled with the rear end of the balancer shaft 41 placed parallel with the crankshaft 20 oriented in the front-rear direction, the water pump drive shaft 51 of the water pump 50 is coaxially coupled with the front end of the balancer shaft 41 (see FIG. 5), and as shown in FIG. 2 and FIG. 3, the rear-side engine case cover 90 covering the oil pump unit 60 from the rear side which is opposite to the balancer shaft 41 is provided with the clutch oil filter Fc, the engine oil filter Fe, and the oil cooler 100, the clutch oil filter Fc, the engine oil filter Fe. In view of the fact that the oil cooler 100 can be arranged at predetermined positions intensively and efficiently in the vicinity of the oil pump unit 60, the oil circulation path of a lubrication system including an oil passage that communicates with the oil cooler 100 can be set short so that it is possible to improve the oil circulation efficiency, and to reduce the weight by reducing the number of parts.

Because the oil tank To is formed inside the engine case cover 90 and between the rear-side engine case cover 90 and the sidewall 71 of the spacer 70, resulting in the oil pump unit 60 (the scavenging pump Ps, the clutch oil pump Pc, the engine oil pump Pe), the clutch oil filter Fc interposed in the discharge oil passages b3, b4 of the clutch oil pump Pc, the engine oil filter Fe interposed in the discharge oil passage c2 of the engine oil pump Pe, and the oil cooler 100 being provided around the oil tank To, the lubrication system can be structured intensively and downsized.

Because the cooler inlet 92 and the cooler outlet 93 of the oil cooler 100 are formed on the attachment surface 94 to which the oil cooler 100 of the rear-side engine case cover 90 is attached, oil piping to the oil cooler 100 is not necessary, the number of parts can be reduced, and downsizing is possible.

Also, because the cooler outlet 93 opens at an upper part of the oil tank To, oil cooled by the oil cooler 100 is caused to fall from a high position of the oil tank To, and mixes vigorously with oil collected in the oil tank To. Thus, the oil can be efficiently stirred, and the temperature can be efficiently adjusted.

As illustrated in FIG. 2, because the engine oil filter Fe is provided at approximately the same height as the engine oil pump Pe (oil pump unit 60), and the clutch oil filter Fc is provided at a position lower than the clutch oil pump Pc, the discharge hydraulic pressure of the oil pumps Pe, Pc that pressure-feed the oil to the oil filters Fe, Fc can be kept low. Thus, sufficient oil can be supplied to each requiring portion of the internal combustion engine E without upsizing of the oil pumps Pe, Pc.

As illustrated in FIG. 5, with regard to the oil pump unit 60, the scavenging pump Ps that pumps up oil to the oil tank To, the clutch oil pump Pc that pressure-feeds oil from the oil tank To to the hydraulic twin clutches 30, and the engine oil pump Pe that supplies oil to each lubrication portion of the internal combustion engine E are arrayed to share the oil pump drive shaft 61, the three types of oil pumps Ps, Pc, Pe can be formed into a unit compactly.

The clutch oil pump Pc with particularly high oil discharge pressure is placed by being sandwiched between the scavenging pump Ps and the engine oil pump Pe, the pressure resistance of the clutch oil pump chamber 72 can be ensured easily without upsizing of parts.

Because the internal combustion engine E is mounted on a vehicle with the crankshaft 20 being oriented in the vehicle front-rear direction, the water pump 50 is placed on the front side of the balancer shaft 41 parallel with the crankshaft 20, and the oil pump unit 60 is placed on the rear side of the balancer shaft 41 parallel with the crankshaft 20, the water pump 50 provided at a front part of the internal combustion engine E is relatively close to the radiator 18 placed at a front part of the vehicle body, the water piping of the cooling system can be set short with good space efficiency. Thus, it is possible to reduce the weight by reducing the number of parts.

Because the cooler inflow water pipe 57 that makes a water jacket of the cylinder block 22 and a water jacket of the oil cooler 100 of the internal combustion engine E communicate with each other is provided, a water circulation path for circulation through the oil cooler 100 becomes possible without laying a pipe dedicated to pressure-feeding from the water pump 50 to the oil cooler 100. In addition, because the oil cooler 100 provided in the vicinity of the oil pump unit 60 is also positioned relatively close to the cylinder block 22 of the internal combustion engine E, this water piping that makes the water jacket of the cylinder block 22 and the water jacket of the oil cooler 100 communicate with each other is allowed to be short. Thus, it is possible for a reduction in the number of parts to reduce the weight.

It should be noted that as shown in FIG. 2, the cooler outflow water pipe 58 that extends out from the oil cooler 100 attached to the rear-side engine case cover 90 covering the crankcase 21 of the internal combustion engine E from behind, and is coupled with the water pump 50, is also laid along the left side surface of the crankcase 21 of the internal combustion engine E, and can be set relatively short as compared with a conventional structure where the oil cooler 100 is disposed at a front area of the vehicle body, and water piping that circulates through the oil cooler 100 is generally short.

Although the oil supply structure of the water-cooled internal combustion engine in one embodiment according to the present invention has been explained so far, aspects of the present invention are not limited to the above-mentioned embodiment, but include those that are implemented in various aspects within the range of the gist of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil supply structure of a water-cooled internal combustion engine in which an oil pump drive shaft of an oil pump is coaxially coupled with one end of a balancer shaft placed parallel with a crankshaft and a water pump drive shaft of a water pump is coaxially coupled with the other end of the balancer shaft, comprising:

an oil cooler being positioned adjacent to and in communication with the oil pump;

an oil filter being positioned adjacent to and in communication with the oil pump;

an engine case cover for covering the oil pump from a side of the internal combustion engine opposite to a side of the internal combustion engine where the water pump is positioned;

said oil pump comprising:

a scavenging pump for pumping oil to an oil tank;

a clutch oil pump for pressure-feeding oil from the oil tank to a hydraulic clutch; and an engine oil pump for supplying oil to each lubrication portion of the internal combustion engine are placed side by side on the oil pump drive shaft; and said scavenging pump, said clutch oil pump and said engine oil pump being coaxially aligned relative to each other and with the one end of the balancer shaft with said clutch oil pump being sandwiched between the scavenging pump and the engine oil pump.

2. The oil supply structure of the water-cooled internal combustion engine according to claim 1, wherein the oil tank is formed inside the engine case cover;

a cooler inlet and a cooler outlet of the oil cooler are formed on an attachment surface to which the oil cooler of the engine case cover is attached; and the cooler outlet opens at an upper part of the oil tank.

3. The oil supply structure of the water-cooled internal combustion engine according to claim 1, wherein the oil filter is provided at a same height as or a lower position than the oil pump.

4. The oil supply structure of the water-cooled internal combustion engine according to claim 1, wherein the oil filter is composed of a clutch oil filter interposed in a discharge oil passage of the clutch oil pump and an engine oil filter interposed in a discharge oil passage of the engine oil pump, and the clutch oil filter and the engine oil filter are provided in the vicinity of the oil pump.

5. The oil supply structure of the water-cooled internal combustion engine according to claim 1, wherein the internal combustion engine is mounted on a vehicle with the crankshaft being oriented in the vehicle front-rear direction;

the water pump is placed on the front side of the balancer shaft; and the oil pump is placed on the rear side of the balancer shaft.

6. The oil supply structure of the water-cooled internal combustion engine according to claim 1, and further including water piping operatively connected to a water jacket of a cylinder block and a water jacket of the oil cooler of the internal combustion engine for providing communication therebetween.

7. An oil supply structure of a water-cooled internal combustion engine comprising:

an oil pump drive shaft;

an oil pump operatively connected to the oil pump drive shaft and being coaxially coupled with one end of a balancer shaft placed parallel with a crankshaft;

a water pump drive shaft;

a water pump operatively connected to the water pump drive shaft and being coaxially coupled with the other end of the balancer shaft;

an oil cooler operatively positioned adjacent to and in communication with the oil pump together; and an oil filter operatively positioned adjacent to and in communication with the oil pump, said oil filter being provided at a same height as or a lower position than the oil pump;

said oil pump comprising:

a scavenging pump for pumping oil to an oil tank;

a clutch oil pump for pressure-feeding oil from the oil tank to a hydraulic clutch; and an engine oil pump for supplying oil to each lubrication portion of the internal combustion engine are placed side by side on the oil pump drive shaft; and said scavenging pump, said clutch oil pump and said engine oil pump being coaxially aligned relative to each other and with the one end of the balancer shaft with said clutch oil pump being sandwiched between the scavenging pump and the engine oil pump.

8. The oil supply structure of the water-cooled internal combustion engine according to claim 7, wherein an oil tank is formed inside the engine case cover;

a cooler inlet and a cooler outlet of the oil cooler are formed on an attachment surface to which the oil cooler of the engine case cover is attached; and the cooler outlet opens at an upper part of the oil tank.

* * * * *